United States Patent [19]

House

[11] 3,936,974

[45] Feb. 10, 1976

[54] COMBINED TOP AND YO-YO

[76] Inventor: Eugene R. House, Box 189, Road No. 1, Emporium, Pa. 15834

[22] Filed: Aug. 29, 1974

[21] Appl. No.: 501,612

[52] U.S. Cl. ..... 46/61; 46/65

[51] Int. Cl.[2] ..... A63H 1/30

[58] Field of Search ..... 46/61, 64, 65

[56] References Cited

UNITED STATES PATENTS

| | | | |
|---|---|---|---|
| 2,579,022 | 12/1951 | Spencer et al. | 46/61 |
| 3,081,578 | 3/1963 | Mosher | 46/61 |
| 3,413,753 | 12/1968 | Colmer | 46/61 |

*Primary Examiner*—Louis G. Mancene
*Assistant Examiner*—Robert F. Cutting
*Attorney, Agent, or Firm*—O'Brien & Marks

[57] ABSTRACT

A combined top and yo-yo is disclosed as having a pair of discs and opposed hubs mounted on a shaft and a string connected to the shaft effects rotation of the combined top and yo-yo in various combinations.

10 Claims, 6 Drawing Figures

COMBINED TOP AND YO-YO

BACKGROUND OF THE INVENTION

1. Field of the Invention

This invention relates to a combined top and yo-yo and more particularly it relates to a combined top and yo-yo having more than one position for the rotation thereof.

2. Description of the Prior Art

Past designs of tops and yo-yos for amusement and enjoyment of both adults and children have been separate devices. A portable toy top made up of one or more elements has rotated as a unit or has separated into individual rotating units upon rotation of the top. Relatively large top-type devices secured to the ground have also been utilized to satisfy the play of children at certain ages. A yo-yo on the other hand has generally involved a pair of discs and a windable string therebetween for effecting rotation of the yo-yo.

The prior art, as exemplified by U.S. Pat. No. 668,607, No. 2,068,053 and No. 3,785,641 illustrates a variety of toy apparatus and top-like devices.

One of the problems in the prior art is that separate tops and yo-yos have not always proven to be fully satisfactory for amusement purposes. Therefore a combined top and yo-yo would be greate amusement than a single top or yo-yo.

SUMMARY OF THE INVENTION

The present invention is summarized in a combined top and yo-yo that includes a shaft means with opposed ends and a longitudinal axis between the opposed ends, a pair of discs, each one of said pair of discs being concentrically mounted between the ends of said shaft means and being disposed transversely of said shaft means in opposed and spaced relation to each other, a string means secured to and wound about said shaft means between said pair of discs, opposed hub means disposed at the opposed ends of said shaft means and the pair of discs being interposed between said opposed hub means, and one of said hub means being rotatably mounted about one end of said shaft means and being graspable by a user to support and control the position of said shaft means upon pulling said string means to effect rotation of said shaft means about its longitudinal axis.

An object of the present invention is to provide a combined top and yo-yo that is of simplified and unitized construction.

Another object of the present invention is to provide a combined top and yo-yo that provides amusement for adults or children.

Still another object of the present invention is to provide a combined top and yo-yo that is positionable in more than one position for rotation.

This invention has another object in that the combined top and yo-yo may serve as a top, as a yo-yo or even as a wheel.

Other objects and advantages of the present invention will become apparent from the following description taken in conjunction with the accompanying drawings.

DETAILED DESCRIPTION OF THE PREFERRED EMBODIMENTS

Figure 1:
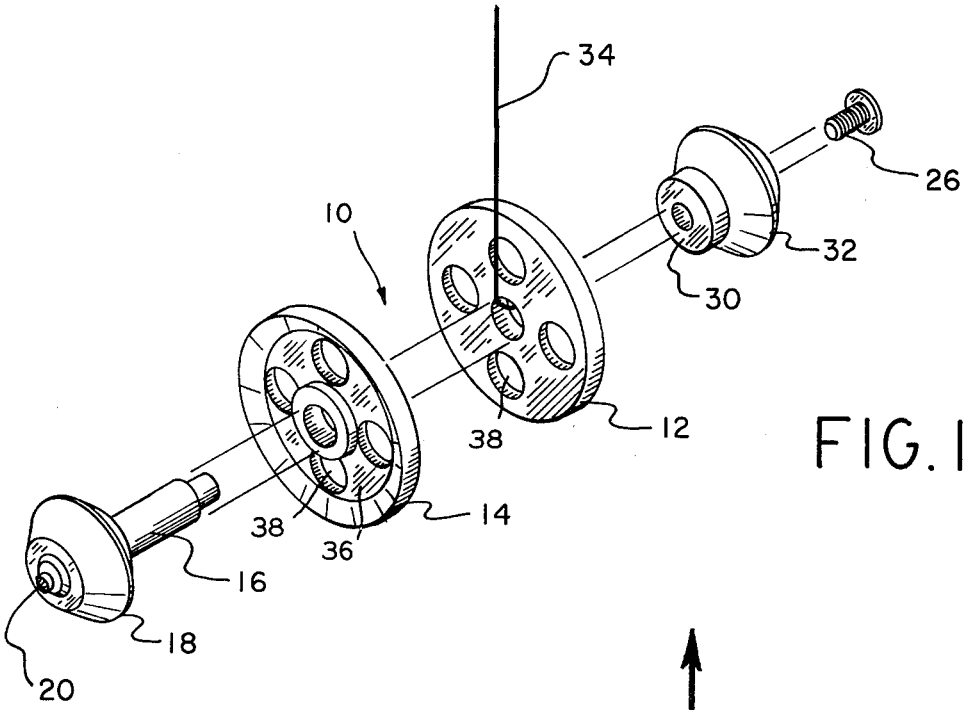
FIG. 1 is an exploded perspective view of a combined top and yo-yo embodying the present invention.
Figure 2:
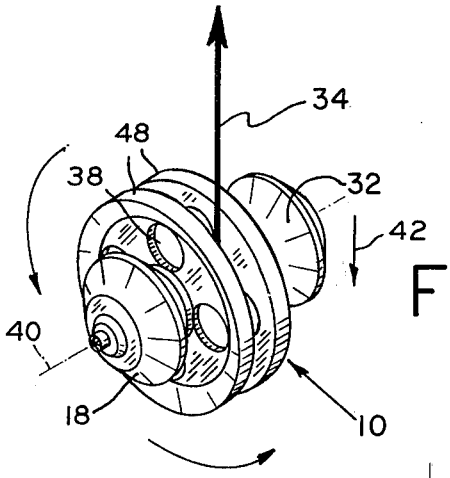
FIG. 2 is a perspective view of the combined top and yo-yo and illustrates a horizontal rotating position thereof.
Figure 3:
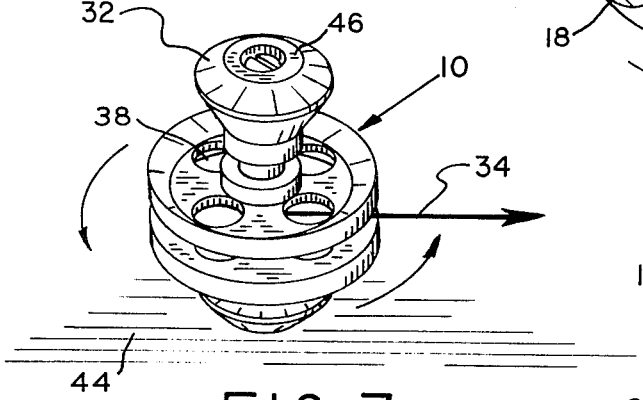
FIG. 3 is another perspective view with parts added and illustrates a vertical rotating position of the combined top and yo-yo.
Figure 4:
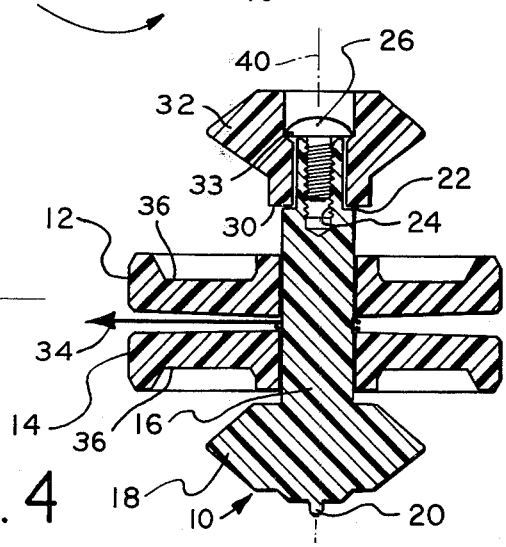
FIG. 4 is an enlarged longitudinal sectional view of the combined top and yo-yo.

The present invention is embodied in a combined top and yo-yo 10 as illustrated in FIGS. 1–4 and includes a shaft 16 having opposed ends. A pair of opposed discs 12 and 14 of corresponding shape are concentrically mounted and affixed between the ends of shaft 16 and are disposed transversely thereof. Further the pair of discs 12 and 14 are arranged on shaft 16 in parallel spaced and reverse relation to each other as shown in FIG. 4.

A hub 18 is disposed at one opposed end of shaft 16 and is integrally formed on the one opposed end thereof. The one opposed end of shaft 16 at its outermost end includes a concentric pin-like or pointed element 20.

The other opposed and reduced end of shaft 16 has a shoulder 22 and an internally threaded end bore 24. The threaded end of a cap screw 26 is threadably connected to the threaded end bore 24 of shaft 16 as indicated in FIG. 4.

Another and hand graspable hub 32 is disposed at and rotatably mounted on the other opposed and reduced end of shaft 16 and has an inner end face 30 that engages the shoulder 22 on shaft 16. Hub 32 is retained on the reduced end of shaft when the threaded end of cap screw 26 engages the internally threaded end bore 24 and the head of cap screw abuts the internal shoulder 33 of hub as shown in FIG. 4.

The inner or one end of a string 24 is inserted in the concentric aperture of disc 12 prior to mounting disc 12 on shaft 16. When disc 12 is mounted on shaft 16 the inner inserted end of string 34 is secured to shaft 16 between disc 12 and shaft 16. The trailing portions of the string 34 are wound counterclockwise about the shaft 16 between the pair of discs 12, 14 as shown in FIG. 4. The outer end face of each disc 12, 14 is concentrically recessed and includes a depressed outer end face 36. A plurality of four equi-spaced apertures 38 of corresponding size extend between depressed outer face 36 and the back face of each disc 12, 14 as illustrated in FIGS. 1–4.

When one hand of the user releases his hand grasp of the rotatable hub 32 when the top and yo-yo 10 is in a horizontal position while at the same time the one hand of the user retains his grasp of the outer end of string 34, the top and yo-yo 10 not only rotates counterclockwise about the longitudinal axis 40 of shaft 16 but it also travels from a raised position to a lower position as indicated by the directional arrow 42 in FIG. 2; and thus the top and yo-yo 10 functions as a yo-yo.

One hand of the user may grasp the other hub 32 and hold the top and yo-yo 10 in an upright position relative to a support surface 44 and with pin-like element 20 in engagement with the support surface 44 as shown in FIG. 3. As the other hand of the user grasps and pulls the outer end of rewound string 34 the top and yo-yo 10 will rotate counterclockwise and function as a top. By reason of the balanced construction of the top and yo-yo 10 one hand of the user may grasp the other hub 32 and hold the top and yo-yo 10 in an inverted and upright position relative to support surface 44 and with the outer end face 46 of inverted hub 32 in engagement with surface 44. Then the other hand of the user in grasping and pulling the outer end of rewound string 34, the top and yo-yo 10 is rotated counterclockwise in an inverted and upright position; and hence the top and yo-yo 10 again functions as a top.

One hand of the user may grasp and pull the outer end of string 34 to rotate the top and yo-yo 10 counterclockwise about the axis 40 of shaft 16. At the same time, the other hand of the user in grasping hub 32 holds the top and yo-yo 10 in a horizontal position relative to surface 44, and then places the outer peripheral surfaces 48, 48 of discs 12, 14 in engagement with surface 44 thereby causing the top and yo-yo 10 to roll to the left as viewed in FIG. 2 and thus the top and yo-yo 10 functions as a wheel.

Figure 5:
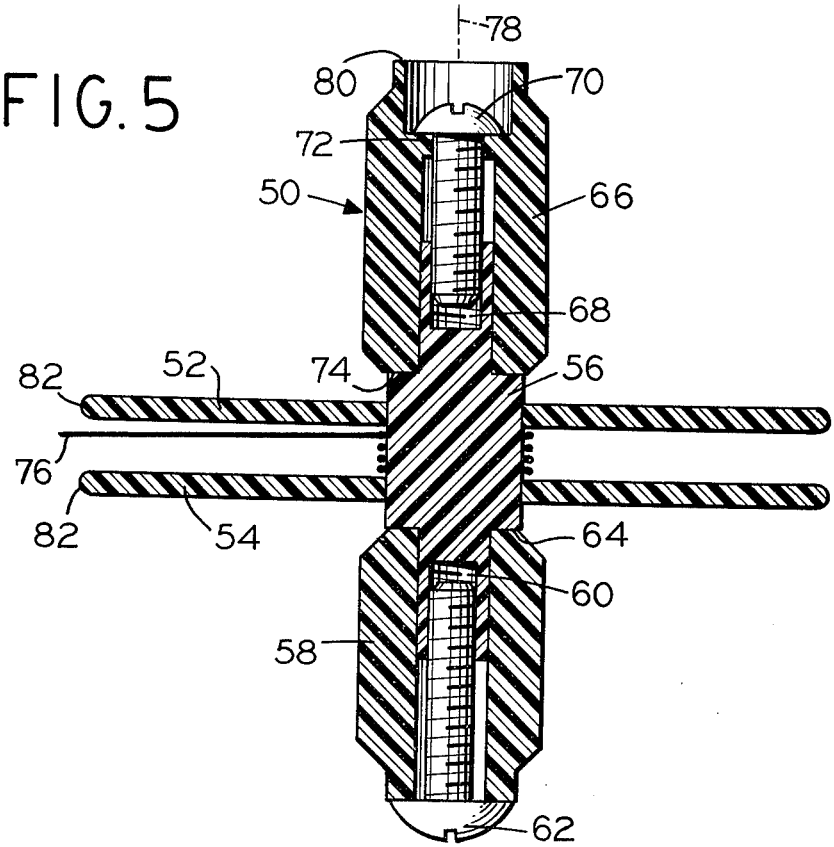
FIG. 5 is a longitudinal sectional view of another embodiment of the combined top and yo-yo of the present invention.

In another embodiment a combined top and yo-yo 50 of the present invention as illustrated in FIG. 5 includes a shaft 56 having opposed and reduced ends. A pair of relatively thin opposed discs 52, 54 of corresponding flat shape are concentrically mounted between the ends of the shaft 56 and are disposed transversely of shaft 56 in parallel spaced relation to each other.

A hand graspable hub 58 is rotatably mounted on one opposed end of shaft 56. Hub 58 is retained on the lower end of shaft 56 when the threaded end of a cap screw or fastening element 62 threadbly engages the internally threaded end bore 60 of one opposed end of shaft 56 and the head of cap screw 62 engages the lower end of hub 58 as shown in FIG. 5. The upper end 64 of hub 58 engages the lower shoulder of shaft 56.

Another hand graspable hub 66 is rotatably mounted on the other opposed and reduced end of shaft 56. The threaded end of a cap screw 70 theadably engages the internally threaded end bore 68 of the other opposed and reduced end of shaft 56 thereby retaining the other hub 66 to the other opposed and reduced end of shaft 56. At this time the head of cap screw 70 abuts the inner annular ridge 72 of hub 66 and the lower end 74 of hub 66 abuts the upper shoulder of shaft 56 as viewed in FIG. 5. Opposed ends of hubs 58 and 66 may be beveled in the manner shown in FIG. 5.

The inner or one end of a string 76 is secured to shaft 56 between discs 52, 54 in similar fashion as with the inner end of string 34 in the aforedescribed top and yo-yo 10 of FIGS. 1–4.

One hand of a user may grasp and pull the outer end of the string 76 while the user releases his grasp of either hub 58 or 66 causing the top and yo-yo 50 to function as a yo-yo in rotating counterclockwise about its longitudinal axis 78 of shaft 56 and in travelling from a raised position to a lower position as indicated by arrow 42 in FIG. 2.

With one hand of the user grasping hub 66 and holding the top and yo-yo 50 in an upright position and with the head of cap screw 62 in engagement with the support surface 44, the other hand of the user grasps and pulls the outer end of rewound string 76 to effect counterclockwise rotation of the combined top and yo-yo 50 thereby causing the top and yo-yo 50 to function as a top. Further, one hand of the user grasps hub 58 and holds the combined top and yo-yo 50 in an inverted and upright position relative to support surface 44 and with the outer annular end face 80 of sleeve 66 in engagement with surface 44. Then when the other hand of the user pulls and grasps the outer end of rewound string 76 the top and yo-yo 50 will rotate counterclockwise about its longitudinal axis 78 in an inverted and upright position relative to surface 44 thereby functioning again as a top.

Furthermore one hand of the user may grasp either hub 58 or 66 and hold the top and yo-yo 50 in a horizontal position while the other hand grasps and pulls the outer end of rewound string 76 thereby causing counterclockwise rotation of the top and yo-yo 50. If the one hand places the outer peripheral surfaces 82, 82 of discs 52, 54 in engagement with support surface 44, the top and yo-yo 50 will move along surface 44 as a wheel in similar fashion as the top and yo-yo 10 in FIGS. 1–4 and as shown in FIG. 2.

Figure 6:
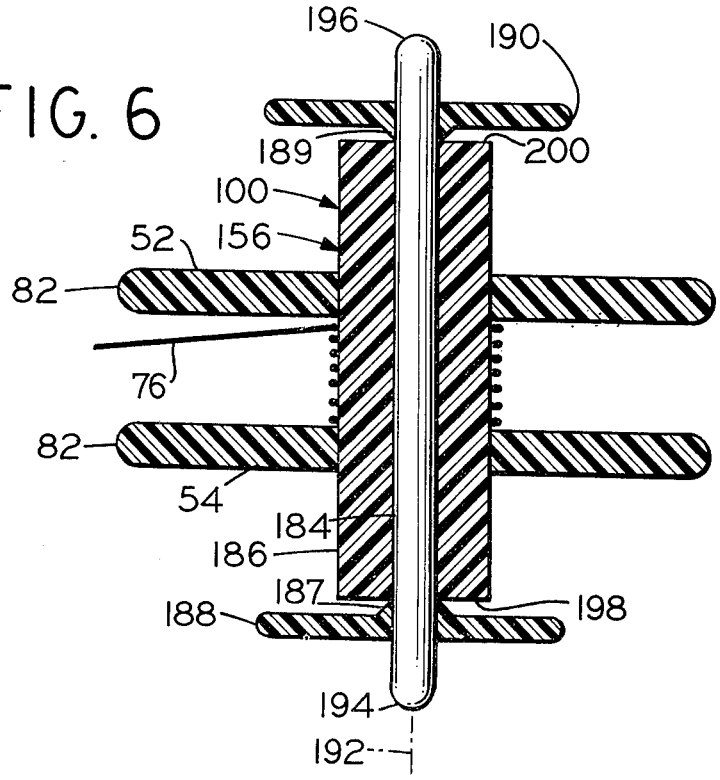
FIG. 6 is a longitudinal sectional view of still another embodiment of the combined top and yo-yo of the present invention.

In still another embodiment, a combined top and yo-yo 100 of the present invention is illustrated in FIG. 6. Reference numerals in FIG. 6 with like numerals in FIG. 5 refer to identical parts that have the same structure and function. On the other hand reference numerals in FIG. 6 that refer to similar parts in FIG. 5 have the same reference numeral with 100 added. For example shaft 56 in FIG. 5 is identified as shaft 156 in FIG. 6.

Shaft 156 includes an inner rod-like shaft 184 and an outer sleeve-like shaft 186 concentrically and rotatably mounted about inner shaft 184. Opposed ends of inner shaft 184 extend beyond the opposed ends of outer shaft 186 as illustrated in FIG. 6. Opposed and hand graspable hub elements 188, 190 are concentrically mounted and affixed about the opposed ends of inner shaft 184 and in parallel spaced relation to each other transversely of shaft 184. Opposed inner faces of opposed hubs 188, 190 include concentrically arranged opposed and reversed frusto-conically shaped protrusions 187 and 189. When the outer shaft 186 is rotated about inner shaft 184 upon pulling the outer end of string 76, minimal frictional engagement occurs between opposed protrusions 187, 189 and opposed end faces 198, 200 of outer shaft 186 thereby permitting substantially free rotation of outer shaft 186 and discs 52, 54 about the longitudinal axis 192 of the top and yo-yo 100. Hence outer shaft 186 is retained on inner shaft 184 between opposed hubs 188, 190.

Upon the user grasping either hub 188 or 190, the combined top and yo-yo 100 may be rotated as a top about its longitudinal axis 192 in an upright or an upright and inverted position when the outer end of string 76 is pulled as the outer opposed end surface 194 or 196 of inner shaft 184 is placed in engagement with support surface 44 in FIG. 3. The combined top and yo-yo 100 may also function as a yo-yo or even as a wheel when outer peripheral surfaces 82, 82 of discs 52, 54 are in rolling engagement with support surface 44 in similar fashion as with the top and yo-yos 10 and 20 of FIGS. 1–4 and 5.

The combined tops and yo-yos 10, 50 and 100 of the present invention may be made of appropriate materials such as a suitable grade of plastic material. By reason of the hand of a user grasping rotatable hub 32, either rotatable hub 58 or 66 or either hub 188 or 190, the combined top and yo-yo 10, 50 or 100 is easily controlled and manipulated to any desired position so that the top and yo-yo 10, 50 or 100 will function as a top, a yo-yo or a wheel as aforedescribed.

Since the present invention is subject to many modifications, variations and changes in detail, it is intended that all matter contained in the foregoing description or shown in the accompanying drawings shall be interpreted as illustrative and not in a limiting sense.

What is claimed is:

1. A combined top and yo-yo comprising shaft means having opposed ends and a longitudinal axis between the opposed ends, a pair of discs, each one of said pair of discs being concentrically and securely mounted to and between the ends of said shaft means and being disposed transversely of said shaft means in opposed and spaced relation to each other, a string secured to and wound about said shaft means between said pair of discs, opposed hub means disposed at the opposed ends of said shaft means and the pair of discs being interposed between said opposed hub means, and one of said hub means being rotatably mounted about one end of said shaft means and being graspable to a user to support and control the position of said shaft means upon pulling said string means to effect rotation of said shaft means about its longitudinal axis.

2. A combined top and yo-yo as set forth in claim 1 wherein each one of said pair of discs includes a plurality of apertures.

3. A combined top and yo-yo as set forth in claim 1 wherein fastener means is connected to the one opposed end of said shaft means and to said one hub means, and said fastener means retains said one hub means on the one opposed end of said shaft means.

4. A combined top and yo-yo as set forth in claim 1 wherein a support surface is disposed on said shaft means, and the other opposed end of said shaft means includes means engaging the support surface during rotation of said shaft means about its longitudinal axis when said shaft means is disposed in an upright position.

5. A combined top and yo-yo as set forth in claim 1 wherein a support surface is disposed on said pair of discs, and the outer peripheral surface means of the pair of discs are in rolling engagement with the support surface during rotation of said shaft means about its longitudinal axis when said shaft means is disposed in a horizontal position.

6. A combined top and yo-yo as set forth in claim 1 wherein a support surface is disposed on said one opposed hub means, and the outer end of said one opposed hub means includes means engaging the support surface during rotation of said shaft means about its longitudinal axis when said shaft means is disposed in an inverted and upright position.

7. A combined top and yo-yo as set forth in claim 1 wherein the other opposed hub means is rotatably mounted about the other opposed end of said shaft means.

8. A combined top and yo-yo as set forth in claim 1 wherein said shaft means includes an inner shaft means and an outer sleeve-like shaft means concentrically and rotatably mounted about said inner shaft means, and said pair of discs are concentrically mounted between the opposed ends of said outer sleeve-like shaft means and in opposed and spaced relation to each other.

9. A combined top and yo-yo as set forth in claim 8 wherein the opposed ends of said inner shaft means extend beyond the opposed ends of said outer sleeve-like shaft means, and opposed hub means are concentrically mounted and affixed to the opposed ends of said inner shaft means.

10. A combined top and yo-yo as set forth in claim 9 wherein at least one of said opposed hub means includes a protruding means for frictionally engaging one of the opposed ends of said outer shaft means when said outer shaft means is rotated relative to said shaft means.

* * * * *